US007564988B2

(12) United States Patent
Azima et al.

(10) Patent No.: US 7,564,988 B2
(45) Date of Patent: Jul. 21, 2009

(54) AUDIO APPARATUS

(75) Inventors: Henry Azima, Huntingdon (GB); Nicholas Patrick Roland Hill, Huntingdon (GB); Robin Christopher Cross, Huntingdon (GB); Timothy Christopher Whitwell, Huntingdon (GB); Johan Frank Van Der Linde, Huntingdon (GB)

(73) Assignee: New Transducers Limited, Huntingdon Cambs (GB)

( * ) Notice: Subject to any disclaimer, the term of this patent is extended or adjusted under 35 U.S.C. 154(b) by 400 days.

(21) Appl. No.: 10/571,319

(22) PCT Filed: Sep. 10, 2004

(86) PCT No.: PCT/GB2004/003863

§ 371 (c)(1),
(2), (4) Date: Jun. 27, 2006

(87) PCT Pub. No.: WO2005/025267

PCT Pub. Date: Mar. 17, 2005

(65) Prior Publication Data

US 2007/0025574 A1 Feb. 1, 2007

Related U.S. Application Data

(60) Provisional application No. 60/501,425, filed on Sep. 10, 2003.

(30) Foreign Application Priority Data

Sep. 10, 2003 (GB) ..... 0321617.3

(51) Int. Cl.
*H04R 25/00* (2006.01)

(52) U.S. Cl. ..... 381/326; 381/330; 381/380

(58) Field of Classification Search ..... 381/23.1, 381/150–152, 190, 312, 322, 326, 327, 330, 381/380, 381, 386
See application file for complete search history.

(56) References Cited

U.S. PATENT DOCUMENTS 2,045,427 A * 6/1936 White ..... 381/151

(Continued)

FOREIGN PATENT DOCUMENTS

EP 0 351 461 A1 1/1990

(Continued)

OTHER PUBLICATIONS

Office Action of Jul. 23, 2003 in U.S. Appl. No. 09/969,028.

(Continued)

*Primary Examiner*—Brian Ensey
(74) *Attorney, Agent, or Firm*—Roylance, Abrams, Berdo & Goodman, L.L.P.

(57) ABSTRACT

Audio apparatus (30) comprising a piezoelectric transducer (44) and coupling means (54) for coupling the transducer to a user's pinna (32) whereby the transducer excites vibration in the pinna (32) to cause it to transmit an acoustic signal from the transducer (44) to a user's inner ear, characterised in that the transducer is embedded in a casing (42) of relatively soft material and the casing (42) is mounted to a housing (34) of relatively hard material such that a cavity (48) is defined between the casing (42) and housing (34). A method of designing audio apparatus comprising mechanically coupling a piezoelectric transducer to a user's pinna and driving the transducer so that the transducer excites vibration in the pinna to cause it to transmit an acoustic signal from the transducer to a user's inner ear, characterised by embedding the transducer in a casing of relatively soft material and by mounting the casing to protective housing of relatively hard material such that a cavity is defined between the casing and housing.

17 Claims, 5 Drawing Sheets

U.S. PATENT DOCUMENTS

| | | | | |
|---|---|---|---|---|
| 5,729,615 | A | 3/1998 | Yang | |
| 6,427,018 | B1 | 7/2002 | Keliiliki | |
| 2002/0039427 | A1 * | 4/2002 | Whitwell et al. | 381/312 |

FOREIGN PATENT DOCUMENTS

| | | | |
|---|---|---|---|
| EP | 0351461 | A1 | 1/1990 |
| EP | 0 517 497 | A2 | 12/1992 |
| EP | 0 564 874 | A1 | 10/1993 |
| GB | 541226 | | 1/1941 |
| JP | 56-089200 | A | 7/1981 |
| JP | 59-209000 | A | 11/1984 |
| JP | 2001-320790 | A | 11/2001 |
| WO | WO 97/09842 | A2 | 3/1997 |
| WO | WO 00/13464 | A1 | 3/2000 |
| WO | WO 01/54450 | A2 | 7/2001 |
| WO | WO 01/87007 | A1 | 11/2001 |
| WO | WO 02/30151 | A2 | 4/2002 |
| WO | WO 0230151 | A2 | 4/2002 |

OTHER PUBLICATIONS

Patent Abstracts of Japan, vol. 2002, No. 3, Apr. 3, 2002 & JP 2001 320790 A (Temuko Japan:KK), Nov. 16, 2001.

Patent Abstracts of Japan, vol. 51, No. 59 (E-077), Oct. 14, 1981 & JP 56 089200 A (Matsushita Electric Ind Co Ltd), Jul. 20, 1981.

Patent Abstracts of Japan, vol. 82, No. 68 (E-283), Dec. 7, 1984 & JP 59 139786 A (Matsushita Denki Sangyo KK), Aug. 10, 1984.

* cited by examiner

AUDIO APPARATUS

This application claims the benefit of U.S. provisional application No. 60/501,425, filed Sep. 10, 2003.

TECHNICAL FIELD

The invention relates to audio apparatus and more particularly to audio apparatus for personal use.

BACKGROUND ART

It is known to provide earphones which may be inserted into a user's ear cavity or headphones comprising a small loudspeaker mounted on a headband and arranged to be placed against or over the user's ear. Such sound sources transmit sound to a user's inner ear via the ear drum using air pressure waves passing along the ear canal.

A typical conventional earphone uses a moving coil type transducer mounted in a plastic housing. The moving coil is connected to a light diaphragm which is designed to fit into the entrance of the ear canal. The moving coil and diaphragm are light and are coupled intimately to the eardrum at the other end of the ear canal. The acoustic impedance of the eardrum and ear canal seen by the moving coil transducer is relatively small. This small impedance in conjunction with the intimate coupling means that the motion requirements of the moving coil transducer are relatively low.

A moving coil transducer requires a magnetic circuit, which typically contain metal parts, e.g. steel or iron pole pieces, to generate magnetic field lines for the coil to move. These parts provide a relatively large inertial mass which combined with the low motion requirement means that relatively little vibration enters the housing.

There are disadvantages associated with both headphones and earphones. For example, they may obstruct normal auditory process such as conversation or may prevent a user from hearing useful or important external audio information, e.g. a warning. Furthermore, they are generally uncomfortable and if the volume of the sound being transmitted is too high they may cause auditory overload and damage.

An alternative method of supplying sound to a user's inner ear is to use bone conduction as for example in some types of hearing aids. In this case, a transducer is fixed to a user's mastoid bone to be mechanically coupled to the user's skull. Sound is then transmitted from the transducer through the skull and directly to the cochlea or inner ear. The eardrum is not involved in this sound transmission route. Locating the transducer behind the ear provides good mechanical coupling.

One disadvantage is that the mechanical impedance of the skull at the location of the transducer is a complex function of frequency. Thus, the design of the transducer and the necessary electrical equalisation may be expensive and difficult.

Alternative solutions are proposed in JP56-089200 (Matsushita Electric Ind Co Ltd), WO 01/87007 (Temco Japan Co, Ltd) and WO 02/30151 to the present applicant. In each publication, a transducer is coupled direct to a user's pinna, in particular behind a user's earlobe, to excite vibration therein whereby an acoustic signal is transmitted to the user's inner ear.

As set out in WO 02/30151, the transducer may be piezoelectric. Like the moving coil type transducer in a conventional earphone, the piezoelectric transducer requires protection from mechanical damage. Furthermore, the piezoelectric transducer must be mechanically coupled to the pinna and this coupling must be protected. Accordingly, the transducer may be mounted in a protective housing.

The piezoelectric transducer is not in intimate coupling with the eardrum and drives through the relatively high impedance of the pinna. Furthermore, sound is transmitted to the eardrum through a mechanical coupling rather than an audio coupling. Accordingly, a relatively high level of vibration energy is required to maintain the same level at the eardrum as a conventional earphone.

Unlike in a moving coil type transducer, a piezoelectric transducer does not have a high inertial mass to which the vibrations may be referenced. Accordingly, the housing may vibrate to produce unwanted external sound radiation. Such leakage of sound radiation may annoy nearby listeners and may reduce the privacy for the wearer and is detrimental to the performance of the audio apparatus. Accordingly, an object of the invention is to provide an improved design of housing.

DISCLOSURE OF INVENTION

According to a first aspect of the invention, there is provided audio apparatus comprising a piezoelectric transducer and coupling means for coupling the transducer to a user's pinna whereby the transducer excites vibration in the pinna to cause it to transmit an acoustic signal from the transducer to a user's inner ear, characterised in that the transducer is embedded in a casing of relatively soft material and the casing is mounted to a housing of relatively hard material such that a cavity is defined between the casing and housing.

The pinna is the whole of a user's outer ear. The transducer may be coupled to a rear face of a user's pinna adjacent to a user's concha.

The casing and housing together form a two-part structure which protects the transducer. The use of a two-part structure provides greater flexibility of design to create apparatus which produces minimal unwanted radiation, and has a transducer which is sufficiently protected with good sensitivity. In contrast, mounting a piezoelectric transducer in a one-part housing is less flexible. If a relatively hard material is used this may adversely affect the sensitivity and bandwidth of the apparatus and may lead to unwanted radiation. However, if a relatively soft material is used, the apparatus may not be sufficiently robust.

The casing may be moulded. The relatively soft material may have a Shore hardness in the range of 10 to 100, possibly 20 to 80 and may for example be rubber, silicone or polyurethane. The material may also be non-conducting, non-allergenic and/or waterproof. The material preferably has minimal effect on the performance of the transducer, i.e. does not constrain movement of the transducer and may provide some protection, e.g. from small shocks and the environment, particularly moisture.

The housing is preferably rigid material so as to provide extra protection for the transducer, particularly during handling. The relatively hard material may have a Young's modulus of 1 GPa or higher and may for example be a metal (e.g. aluminium or steel which have Young's moduli of 70 GPa and 207 GPa respectively), hard plastics (e.g. perspex, Acrylonitrile Butadiene Styrene (ABS) or a glass reinforced plastic having a Young's modulus of 20 GPa) or soft plastics having a Young's modulus of 1 GPa.

Both the casing and the housing may be moulded, e.g. in a two step moulding operation. Alternatively, the housing may be cast or stamped. The casing may be a snap-fit in the housing for ease of manufacture.

The coupling between the casing and the housing is preferably minimal to reduce transmission of vibration from the transducer to the housing. The housing may be coupled to the casing at locations on the casing having reduced vibration. The locations may contact regions of the transducer at which vibration is suppressed, e.g. by mounting masses. The locations may be at the opposed ends of the casing.

The cavity may ensure minimal coupling between the casing and the housing. The cavity may also be designed to reduce rear radiation from the transducer which may reduce unwanted radiation from the apparatus. The cavity may have a mechanical impedance ($Z_{cavity}$) which is lower than the output impedance of the transducer and more preferably, lower than the impedance of the pinna ($Z_{pinna}$). Thus the mechanical impedance of the cavity is preferably designed such that it does not limit available force. Therefore the motion of the transducer and available force is not significantly effected by the cavity. Therefore the cavity does not have a detrimental effect on the sensitivity of the device. Where the cavity impedance is less than the pinna impedance, all the available force may be transmitted to the pinna and the cavity has a minimal effect on the operation of the device. The effect of the cavity is then limited to the desired function of mechanical protection and reduction of unwanted external acoustic radiation.

The mechanical properties, in particular mechanical impedance, of the transducer may be selected to match those of a typical pinna. By matching the mechanical properties, in particular the mechanical impedance, improved efficiency and bandwidth may be achieved. Alternatively, the mechanical properties may be selected for suitability to the application. For example, if the matched transducer is too thin to be durable, the mechanical impedance of the transducer may be increased to provide greater durability. Such a transducer may have reduced efficiency but may still be useable.

The mechanical properties of the transducer may be matched to optimise the contact force between the transducer and the pinna, for example by considering one or more parameters selected from smoothness, bandwidth and/or level of the frequency response determined by each subjective user as well as the physical comfort of the user both statically and in the presence of an audio signal. The mechanical properties of the transducer may be selected to optimise the frequency range of the transducer.

The mechanical properties may include the location of the mounting, added masses, the number of piezoelectric layers. The transducer may have an off centre mounting whereby a torsional force is used to provide good contact to the pinna. Masses may be added, for example at the ends of the piezoelectric element, to improve the low frequency bandwidth. The transducer may have multiple layers of piezoelectric material whereby the voltage sensitivity may be increased and the voltage requirement of an amplifier may be reduced. The or each layer of piezoelectric material may be compressed.

The coupling means preferably provide a contact pressure between the pinna and the apparatus so that the apparatus is coupled to the full mechanical impedance of the pinna. If the contact pressure is too light, the impedance presented to the apparatus is too small and the energy transfer may be significantly reduced. The coupling means may be in the form of a hook, an upper end of which curves over an upper surface of the pinna. The lower end may curve under the lower surface of the pinna or may hang straight down behind the pinna. A hook having both ends curving over the pinna may provide a more secure fitting and should maintain sufficient contact pressure for efficient energy transfer.

The housing is mounted to the hook so that the transducer casing contacts a lower part of the pinna, for example the ear lobe. The hook may be made of metal, plastics or rubberised material.

The audio apparatus may comprise a built-in facility to locate the optimum location of the transducer on the pinna for each individual user as taught in WO 02/30151. The audio apparatus may comprise an equaliser for applying an equalisation to improve the acoustic performance of the audio apparatus.

The audio apparatus may be unhanded, i.e. for use on both ears. The manufacture may thus be simpler and cheaper since the tooling costs are reduced. Furthermore, the apparatus may be more user-friendly since a user cannot place the apparatus on the wrong ear and replacements may be easier to obtain. A user may use two audio apparatuses, one mounted on each ear. The signal input may be different to each audio apparatus, e.g. to create a correlated stereo image or may be the same for both audio apparatuses.

The audio apparatus may comprise a miniature built in microphone e.g. for a hands free telephony and/or may comprise a built in micro receiver, for example, for a wireless link to a local source e.g. a CD player or a telephone, or to a remote source for broadcast transmissions.

According to a second aspect of the invention, there is provided a method of designing audio apparatus comprising mechanically coupling a piezoelectric transducer to a user's pinna and driving the transducer so that the transducer excites vibration in the pinna to cause it to transmit an acoustic signal from the transducer to a user's inner ear, characterised by embedding the transducer in a casing of relatively soft material and by mounting the casing to a protective housing of relatively hard material such that a cavity is defined between the casing and housing.

The method may comprise selecting parameters of one or more of the cavity, casing and housing to reduce unwanted radiation, provide protection for the transducer and/or to ensure good sensitivity and bandwidth. In particular, the coupling between the casing and housing and/or the cavity may be selected to reduce unwanted radiation. The material of the casing may be selected to ensure good sensitivity and bandwidth and/or provide some protection for the transducer. The material of the housing may be selected to provide additional protection. The mechanical impedance of the cavity may be lower than the output impedance of the transducer and more preferably, lower than the impedance of the pinna.

The method may comprise measuring the acoustic performance of the audio apparatus for each user and adjusting the location of the transducer on the pinna for each individual user to optimise acoustic performance, for example to provide optimal tonal balance. The optimal position may be measured by determining the angle between a horizontal axis extending through the entrance to the ear canal and a radial line which extends through the entrance and which corresponds to the central axis of the transducer. The angle may be in the range of 9 to 41 degrees of declination.

The method may comprise applying an equalisation to improve the acoustic performance of the audio apparatus. The method may comprise applying compression to the signal applied the transducer, particularly if the transducer is a piezoelectric transducer. The method may comprise optimising the contact force between the transducer and the pinna. The contact force may be optimised by considering parameters such as smoothness, bandwidth and/or level of the frequency response determined by each subjective user as well as the physical comfort of the user both statically and in the presence of an audio signal.

The audio apparatuses and methods described above may be used in many applications, for example hands free mobile phones, virtual conferencing, entertainment systems such as in-flight and computer games, communication systems for emergency and security services, underwater operations, active noise cancelling earphones, tinnitus maskers, call centre and secretarial applications, home theatre and cinema, enhanced and shared reality including data and information interfaces, training applications, museums, stately homes (guided tours) and theme parks and in-car entertainment. Furthermore, the audio apparatus may be used in all applications where natural and unimpeded hearing must be retained, e.g. enhanced safety for pedestrians and cyclists who are also listening to programme material via personal headphones.

A partially deaf person may have good or adequate hearing over part of the frequency range and poor hearing over the rest of the frequency range. The audio apparatus may be used to augment the part of the frequency range for which a partially deaf person has poor hearing without impeding the deaf person's hearing over the rest of the frequency range. For example, the audio apparatus may be used to augment the upper frequency range for a partially deaf person who has good or adequate hearing in the lower part of the frequency spectrum or vice versa. The low frequency range may be below 500 Hz and the high frequency range above 1 kHz.

BRIEF DESCRIPTION OF THE DRAWINGS

For a better understanding of the invention, and purely by way of example, specific embodiments of the invention will now be described, with reference to the accompanying drawings in which.

DETAILED DESCRIPTION

Figure 1:
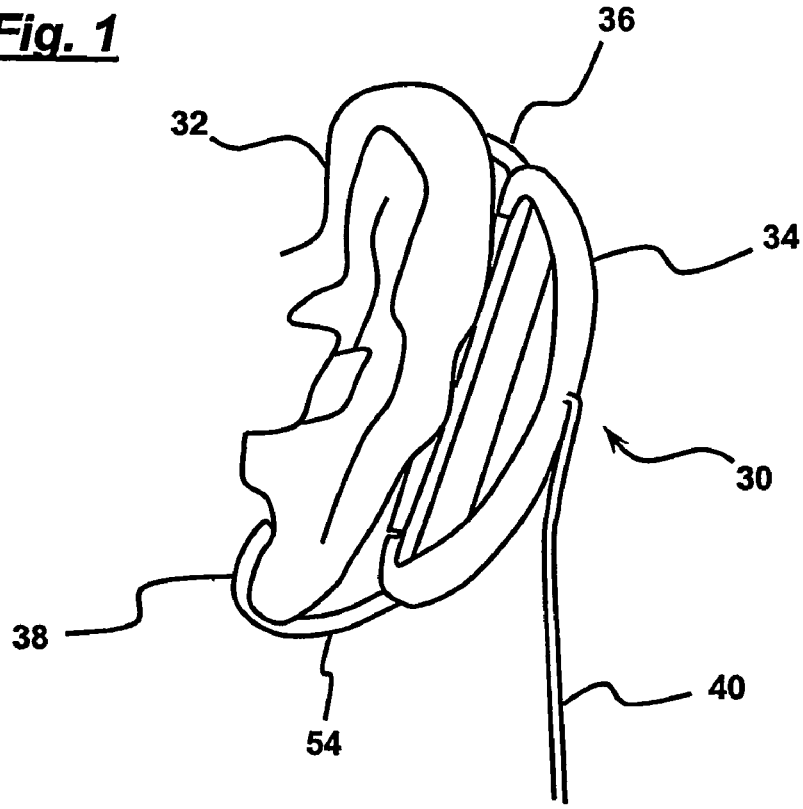
FIG. 1 is a perspective view of an embodiment of the present invention mounted on a pinna.

FIG. 1 shows an audio apparatus 30 according to the present invention mounted on a pinna 32. The apparatus comprises a protective outer housing 34 to which coupling means 54 having upper and lower hooks 36,38 are attached. The hooks 36,38 loop over the upper and lower parts of the pinna 32 respectively to ensure a good contact between the apparatus and the pinna. Leads 40 extend from the housing 34 to be connected to an external sound source.

Figure 2:
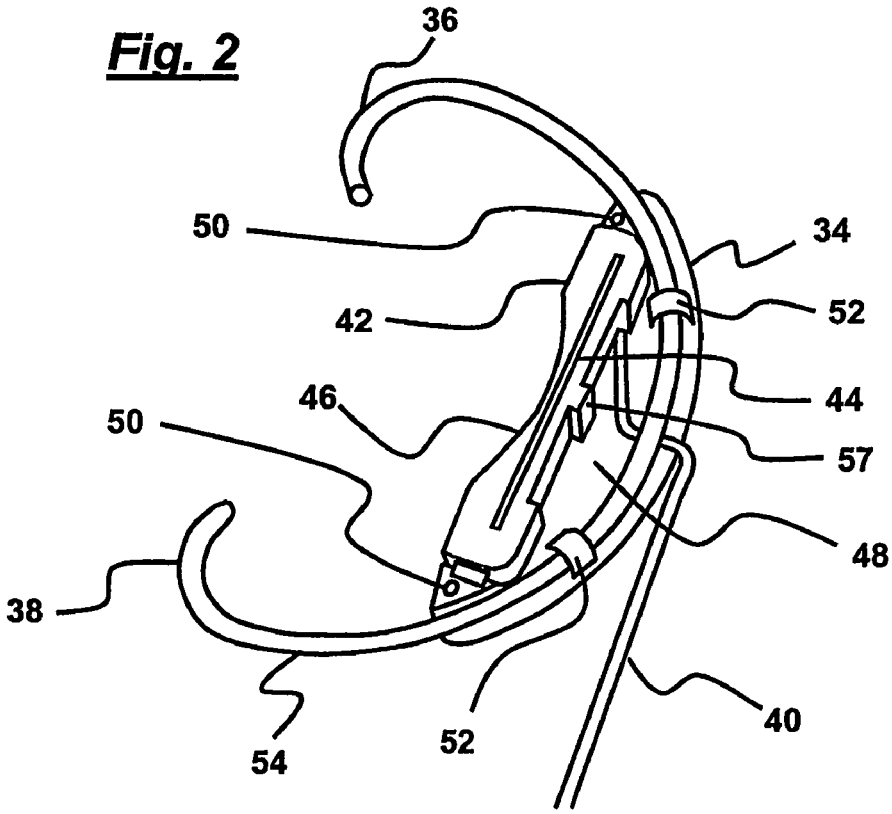
FIG. 2 is a cutaway side view of the audio apparatus of FIG. 1 with parts removed for clarity.
Figure 3:
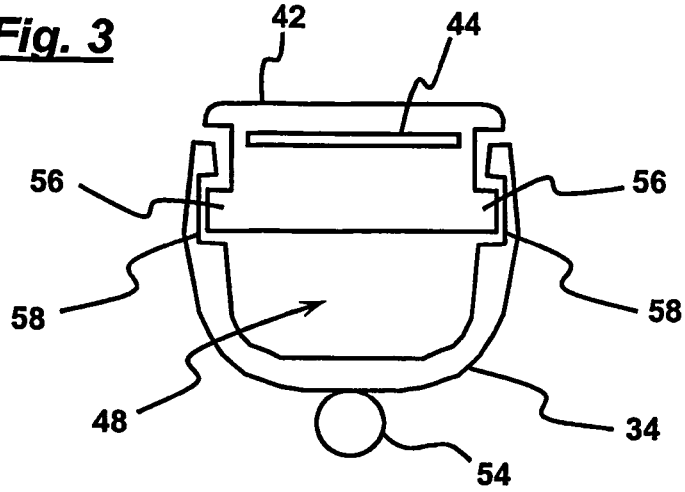
FIG. 3 is a cross-sectional view of the apparatus of FIG. 1, taken at right angles to that of FIG. 2.

As shown in FIGS. 2 and 3, the outer housing 34 is a hollow body which houses a casing 42 in which a piezoelectric transducer 44 is embedded. A cavity 48 is defined between the inner face of the outer housing 34 and the outer face of the casing 42. The casing 42 is of generally rectangular cross-section with a concave section 46 and is shaped so as to provide a snug fit on the user's pinna. The casing 42 is formed from a material which is much softer that the material used for the housing 34.

The outer housing 34 is connected to opposed ends of the casing 42 by connectors 50 which minimise transmission of vibration from the casing 42 to the housing 34. The housing 34 is formed with loops 52 which secure the coupling means 54 thereto.

The casing 42 is formed with a projection 57 along the short axis which provides lugs 56 on either side of the casing 42. The lugs 56 engage in corresponding grooves 58 on the inner face of the outer housing 34. In normal operation the lugs 56 are not in contact with the housing 34 but prevent the casing from being detached from the housing, e.g. if the casing is pulled vertically. The coupling means 54 is secured to the outer face of the outer housing 34.

Figure 4A:
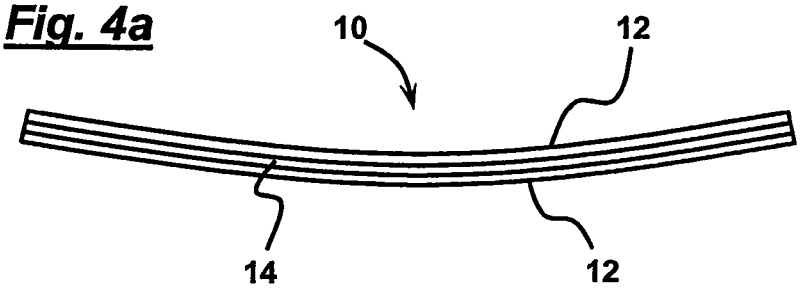
FIGS. 4*a* to 4*c* are side views of alternative piezoelectric transducers which may be used in the present invention.
Figure 4B:
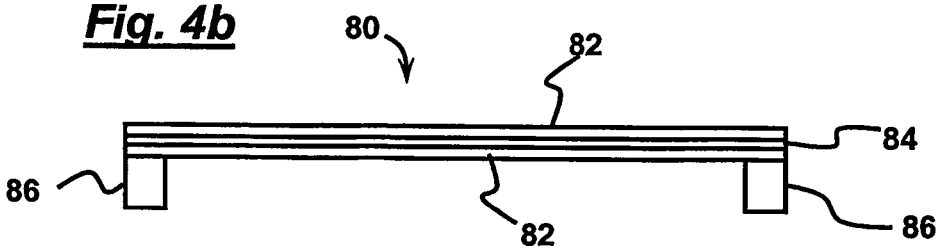
Figure 4C:
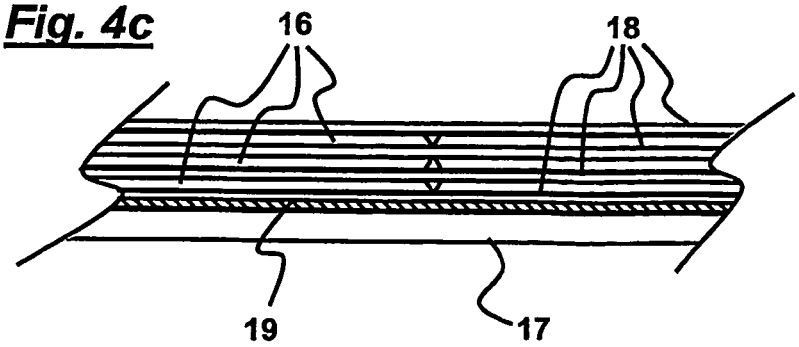

FIGS. 4*a* to 4*c* show alternative piezoelectric transducers which may be used in the present invention. In FIG. 4*a*, the transducer 10 is curved and comprises two curved piezoelectric layers 12 sandwiching a curved shim layer 14. In FIGS. 4*b* and 4*c*, the transducers are not curved and are rectangular of length 28 mm and width 6 mm.

In FIG. 4*b*, the transducer 80 comprises two layers, 82 of piezoelectric material each of thickness 100 micron. Each piezoelectric layer 82 is separated by a shim layer 84 of brass which is 80 micron thick. Masses 86 are mounted to each end of the transducer, e.g. to suppress vibration in the transducer at these regions. The transducer has an output impedance of 3.3 Ns/m. In FIG. 4*c*, the transducer comprises three layers 16 of piezoelectric material (e.g. PZT) alternating with four electrode layers 18 (typically silver palladium). The polarity of each piezoelectric layer 16 is indicated with an arrow. The layers are arranged alternately in a stack with the top and bottom layers being electrode layers 18. The transducer is mounted on an alloy shim 17 and is secured by an adhesive layer 19.

Figure 5:
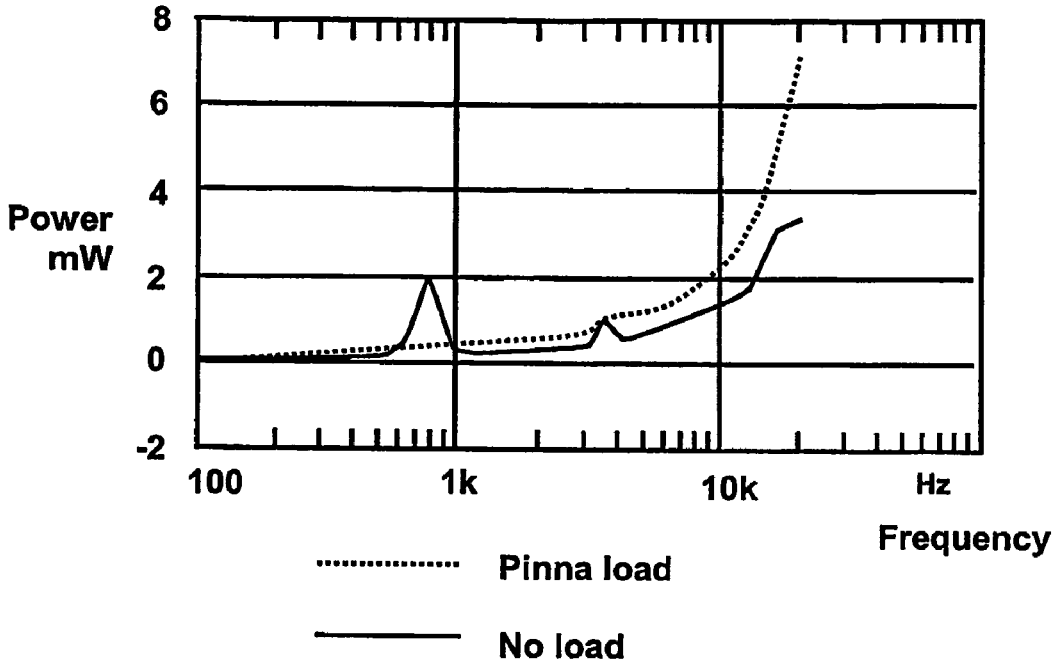
FIG. 5 is a graph of power against frequency for the transducer of FIG. 4*b* when attached to the pinna.

FIG. 5 shows a measurement of the power dissipated in the transducer of FIG. 4*b* when it is attached to the pinna (dotted line) and when it is not attached to the pinna (solid line). When the transducer is mounted to the pinna the power extracted from the transducer is increased since the load of the pinna significantly increases the real part of the electrical impedance of the transducer. Generally, the electrical impedance of a piezoelectric element is predominately capacitive.

Figure 6:
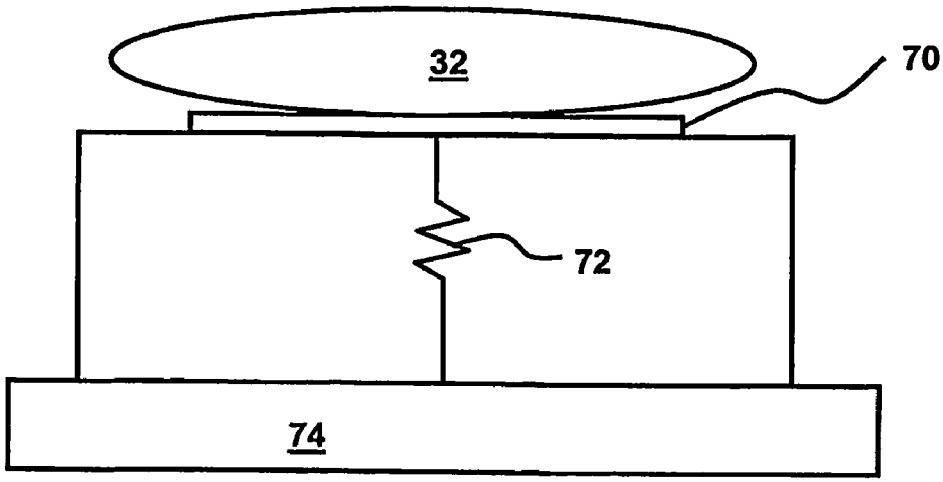
FIG. 6 is a schematic diagram of the mechanical impedances of the component of an audio apparatus according to an aspect of the invention.

The cavity may be designed as set out below with reference to FIGS. 6 to 7B. FIG. 6 shows a schematic diagram of the impedances of the system, namely the impedances of the pinna 32, the transducer 70, the cavity 72 and the outer housing 74. The cavity has a stiffness or mechanical impedance determined by its area and depth. A vibration of the outer housing 74 or casing around the transducer leads to compression of this stiffness and thus the housing and casing may be considered to be coupled to the cavity. The mechanical impedance of the cavity may be estimated by calculating the compliance of an air-load which itself may be estimated (assuming small displacements) from:

$$C_{cavity} = \frac{\text{depth}}{\text{Area} \cdot P_0}$$

where $P_0$ is atmospheric pressure (101 kPa).

The mechanical impedance of the cavity may then be expressed over a frequency range using:

$$Z_{cavity} = \frac{1}{2 \cdot \pi \cdot f \cdot C}$$

The parameters (e.g. size and composition) of the piezoelectric transducer are selected for efficient energy transfer to the mechanical impedance of the pinna over a given bandwidth. One acceptable design of transducer which operates from 500 Hz to 10 kHz comprises five piezoelectric layers and is 28 mm×6 mm. Such a transducer has a mechanical output impedance of 4.47 kg/s. A cavity with the same area as the transducer and a depth of 2.5 mm has an air-load compliance of 1.47×10-4 m/N.

Figure 7A:
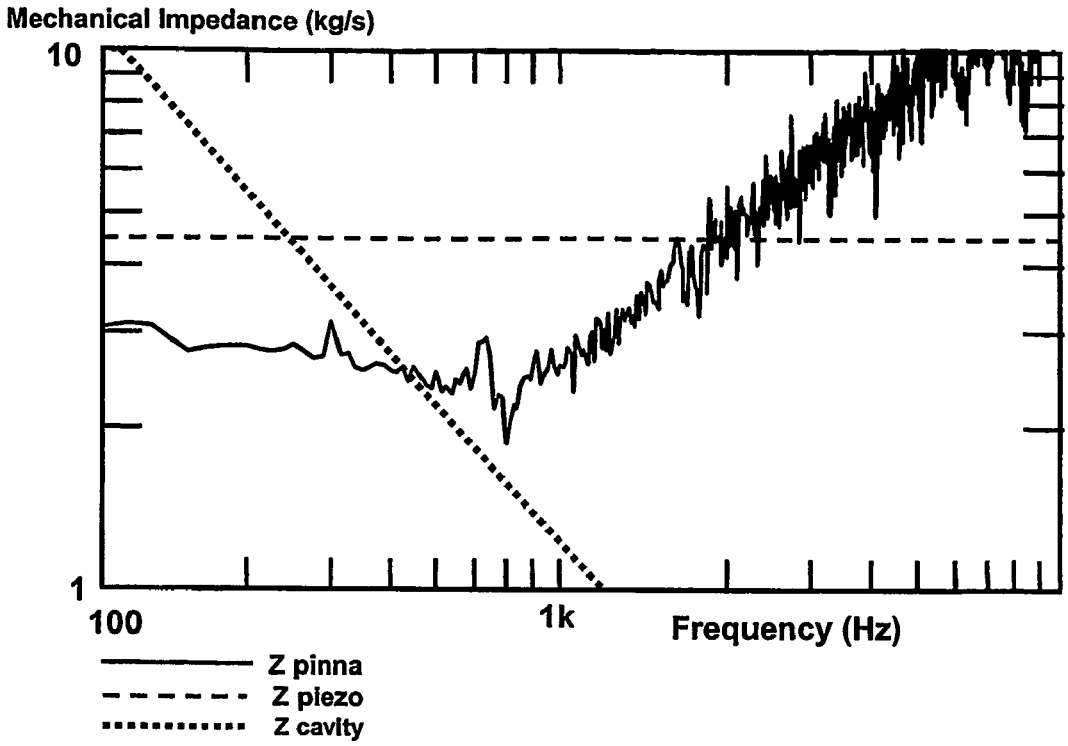
FIG. 7*a* is a graph of the mechanical impedances of the components with frequency.
Figure 7B:
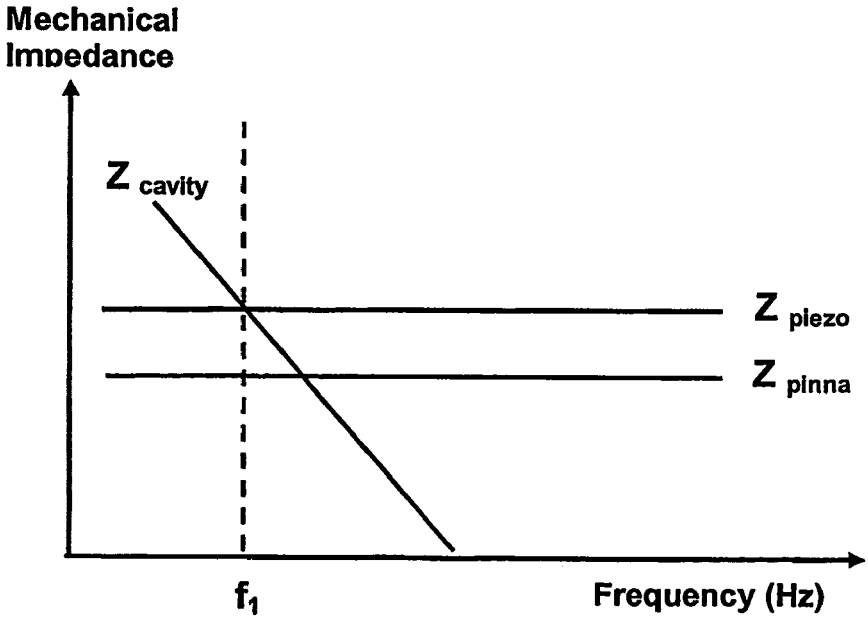
FIG. 7*b* is a simplified version of FIG. 7*a*.

FIG. 7*a* shows the impedance of the cavity (Zcavity), the pinna (Zpinna) and the transducer (Zpiezo) against frequency. The impedance of the pinna is roughly constant with frequency below 1 kHz at a value of Zpinna=2.7 kg/s. Accordingly, the impedance of each component may be simplified as shown in FIG. 7*b*. At a frequency $f_1$ (approx. 420 Hz) the mechanical impedance of the cavity is equal to that of the transducer. Below this frequency the transducer output will be constrained by the action of the cavity and thus $f_1$ should be set as the minimum operating frequency for the apparatus. The frequency of $f_1$ may be lowered by increasing the size (particularly depth) of the cavity to avoid the crossover point occurring in the working band of the apparatus. Making the cavity deep enough minimises the coupling between the casing and/or housing and the cavity in the frequency band of interest.

At the lowest operating frequency, namely 500 Hz, Zcavity=2.17 kg/s and thus Zcavity<Zpiezo and Zcavity<Zpinna. This condition is also satsified throughout the operating frequency, i.e. up to 10 kHz, since Zpiezo is constant, Zpinna is constant to 1 kHz and then rises whereas Zcavity decreases with frequency.

Figure 8:
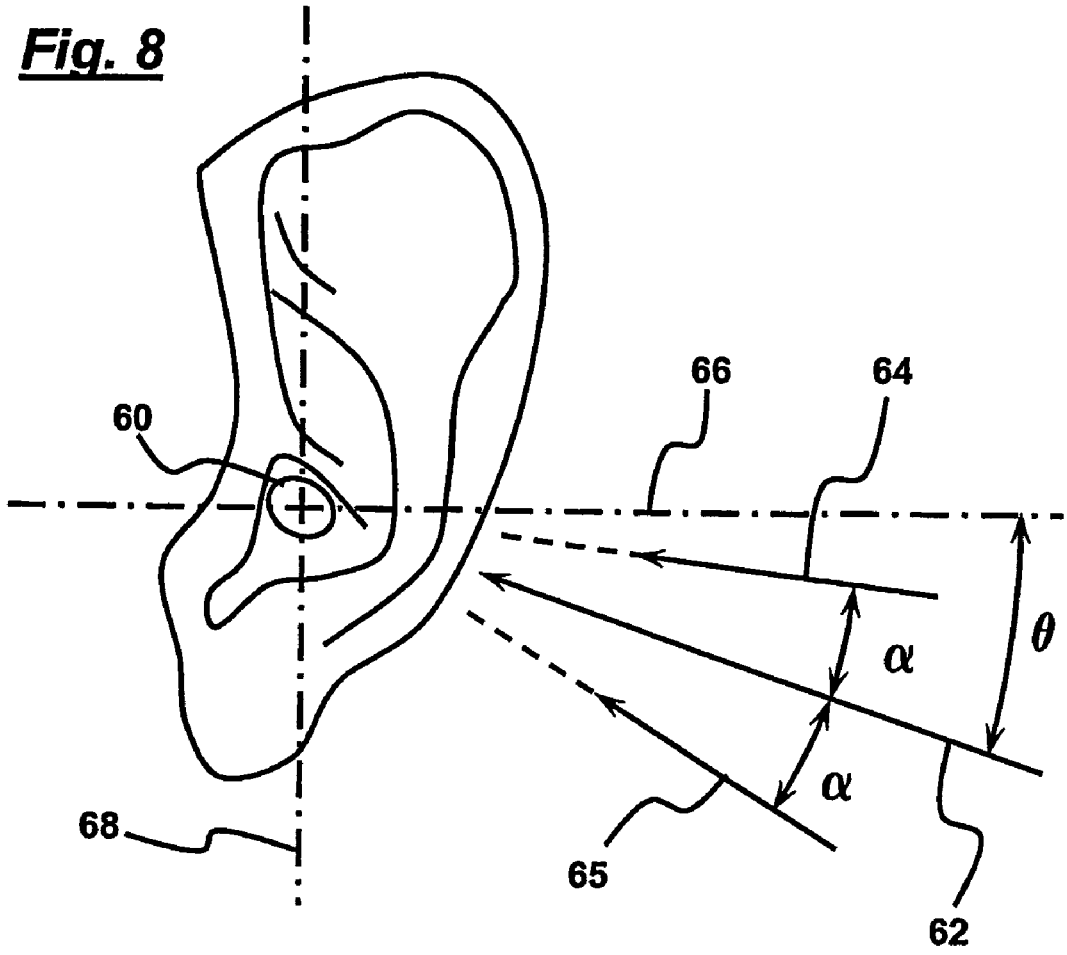
FIG. 8 shows a side view of a user's ear on which an audio apparatus may be mounted in a preferred position.

FIG. 8 shows how the location of the transducer on the pinna may be adjusted for each individual user to provide optimal tonal balance or to optimise other features of the acoustic response. By optimising the location of the transducer, the pinna and the transducer may in effect form a combined driver which is unique to an individual user. The optimal position is measured by determining the angle θ between a central radial line 62 and a horizontal axis 66 both extending through the entrance 60 to the ear canal. The central radial line 62 corresponds to the central axis of the transducer and gives the optimal position for the transducer for a first user.

Upper and lower radial lines 64, 65 both at an angle α to the central radial line 62 show the extent of possible deviation from the central radial line 62 which may lead to the optimum position for a second user. Tests have been conducted which give a value for θ of 25° and for α of 16°. The audio apparatus may comprise a built-in facility to locate the optimum position. The adjustment to the angle may be made by combined movement of the transducer and upper end of the hook. As an alternative to using the horizontal axis, the angle may be measured relative to a vertical axis 68 extending through the entrance 60 to the ear canal.

By mounting the transducer behind the ear, the audio apparatus is unobtrusive, discreet, and does not obstruct or distort the shape of the pinna. The transducer is distanced from and thus does not impede the entrance to the ear canal and thus normal hearing is not affected. Furthermore, there is reduced occlusion of the external ear and hence reduced or no localisation errors when compared to conventional headphones which occlude the ear to varying degrees.

The audio apparatus may be manufactured from low cost, lightweight materials and may thus be disposable. The disposability may be an advantage where hygiene is paramount, e.g. conference use. Alternatively, since the audio is not inserted into the ear, it may be more comfortable and thus more suitable for long term wear.

The invention claimed is:

1. Audio apparatus comprising a piezoelectric transducer and a coupling adapted to couple the transducer to a user's pinna whereby the transducer excites vibration in the pinna to cause it to transmit an acoustic signal from the transducer to a user's inner ear, characterised in that the transducer is embedded in a casing of relatively soft material and the casing is mounted to a housing of relatively hard material such that a cavity is defined between the casing and housing, wherein the parameters of one or more of the cavity, casing and housing are selected to reduce unwanted radiation, to provide protection for the transducer and/or to ensure good sensitivity and bandwidth.

2. Audio apparatus according to claim 1, wherein the transducer is adapted be coupled to a rear face of a user's pinna adjacent to the user's concha.

3. Audio apparatus according to claim 1, wherein the coupling between the casing and the housing is minimal to reduce transmission of vibration from the transducer to the housing, and wherein the housing is coupled to the casing at locations on the casing having reduced vibration.

4. Audio apparatus according to claim 3, wherein the locations contact regions of the transducer at which vibration is suppressed.

5. Audio apparatus according to claim 3, wherein the locations are at opposed ends of the casing.

6. Audio apparatus according to claim 1, wherein the cavity has a mechanical impedance ($Z_{cavity}$) which is lower than the output impedance of the transducer.

7. Audio apparatus according to claim 1, wherein the cavity has a mechanical impedance lower than the impedance of the pinna ($Z_{pinna}$).

8. Audio apparatus according to claim 1, wherein the coupling provides a contact pressure between the pinna and the apparatus so that the apparatus is coupled to the full mechanical impedance of the pinna.

9. Audio apparatus according to claim 1, wherein the coupling is in the form of a hook, an upper end of which curves over an upper surface of the pinna.

10. Audio apparatus according to claim 9, wherein a lower end of the hook curves under the lower surface of the pinna.

11. Audio apparatus according to claim 9, wherein the housing is mounted to the hook so that the transducer casing contacts a lower part of the pinna.

12. A method of designing audio apparatus comprising mechanically coupling a piezoelectric transducer to a user's pinna and driving the transducer so that the transducer excites vibration in the pinna to cause it to transmit an acoustic signal from the transducer to a user's inner ear, characterised by embedding the transducer in a casing of relatively soft material and by mounting the casing to protective housing of relatively hard material such that a cavity is defined between the casing and housing and by selecting parameters of one or more of the cavity, casing and housing to reduce unwanted radiation, to provide protection for the transducer and/or to ensure good sensitivity and bandwidth.

13. A method according to claim 12, wherein the coupling between the casing and housing and/or the cavity is selected to reduce unwanted radiation.

14. A method according to claim 12 wherein the mechanical impedance of the cavity is selected to be lower than the output impedance of the transducer.

15. A method according to claim 14, wherein the mechanical impedance of the cavity is selected to be lower than the impedance of the pinna.

16. A method according to claim 12, comprising measuring the acoustic performance of the audio apparatus for each user and adjusting the location of the transducer on the pinna for each individual user to optimise acoustic performance.

17. A method according to claim 16, wherein the optimal position is measured by determining the angle between a horizontal axis extending through the entrance to the ear canal and a radial line which extends through the entrance and which corresponds to the central axis of the transducer.

* * * * *